US005551529A

United States Patent [19]

Molitor

[11] Patent Number: 5,551,529

[45] Date of Patent: Sep. 3, 1996

[54] LADDER STABILIZER

[76] Inventor: Daniel J. Molitor, 8824 Rocky Rd., Galena, Ill. 61036

[21] Appl. No.: 342,816

[22] Filed: Nov. 21, 1994

[51] Int. Cl.[6] ..... E06C 7/44

[52] U.S. Cl. ..... 182/204; 182/111; 182/172

[58] Field of Search ..... 182/200–205, 182/111, 108, 107, 172

[56] References Cited

U.S. PATENT DOCUMENTS

| | | | |
|---|---|---|---|
| 2,177,677 | 10/1939 | Staben . | |
| 2,306,797 | 12/1942 | Biery . | |
| 2,914,135 | 11/1959 | Crouch . | |
| 2,936,849 | 5/1960 | Larson | 182/204 |
| 3,908,796 | 9/1975 | Hurwitz . | |
| 3,937,298 | 2/1976 | Hurwitz . | |
| 4,207,886 | 1/1980 | Sorenson | 182/204 X |
| 4,423,797 | 1/1984 | Batten . | |
| 4,671,383 | 6/1987 | Huang | 182/204 |
| 4,792,017 | 12/1988 | Grove . | |
| 4,844,208 | 7/1989 | Veness . | |
| 5,094,320 | 3/1992 | Deitz | 182/204 |
| 5,107,958 | 4/1992 | Johnson . | |
| 5,273,133 | 12/1993 | Thocher | 182/202 |
| 5,307,900 | 5/1994 | Noga | 182/204 |

*Primary Examiner*—Alvin C. Chin-Shue
*Attorney, Agent, or Firm*—Bullwinkel Partners, Ltd.

[57] ABSTRACT

A device for stabilizing an aluminum or fiberglass type ladder on a level or uneven surface comprises a pair of frames that attach to either side of the ladder by means of rods inserted through the rungs of the ladder. The rods improve the structural integrity of the ladder by preventing twisting. Legs that slide within the frames may be independently adjusted to the desired height. Feet attached to the legs swivel to any angle, maximizing contact with the surface, even when the ladder is being raised or lowered. The feet are equipped with hard rubber cleats for use on almost any terrain. Electrically non-conductive bushings isolate the ladder from the ground, minimizing the possibility of electrical shock.

2 Claims, 2 Drawing Sheets

FIG. 1
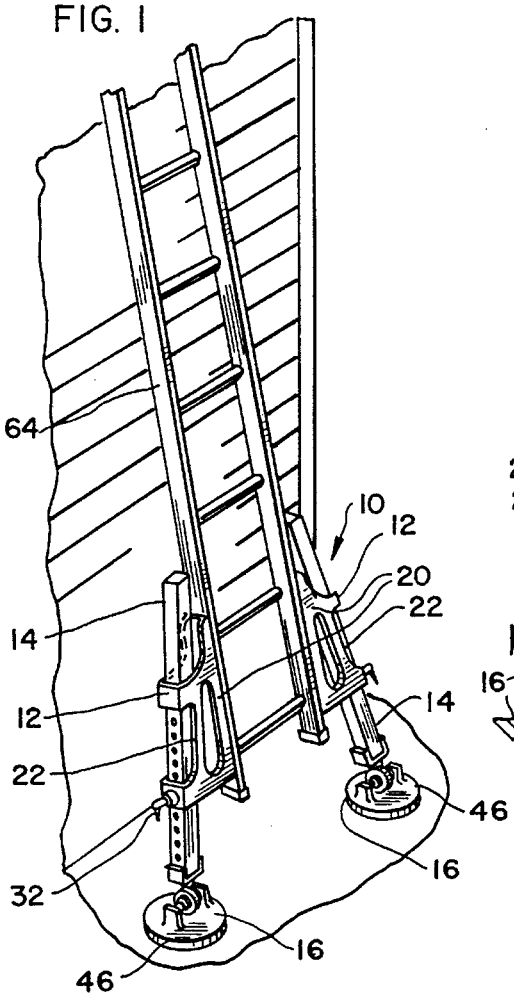
FIG. 2
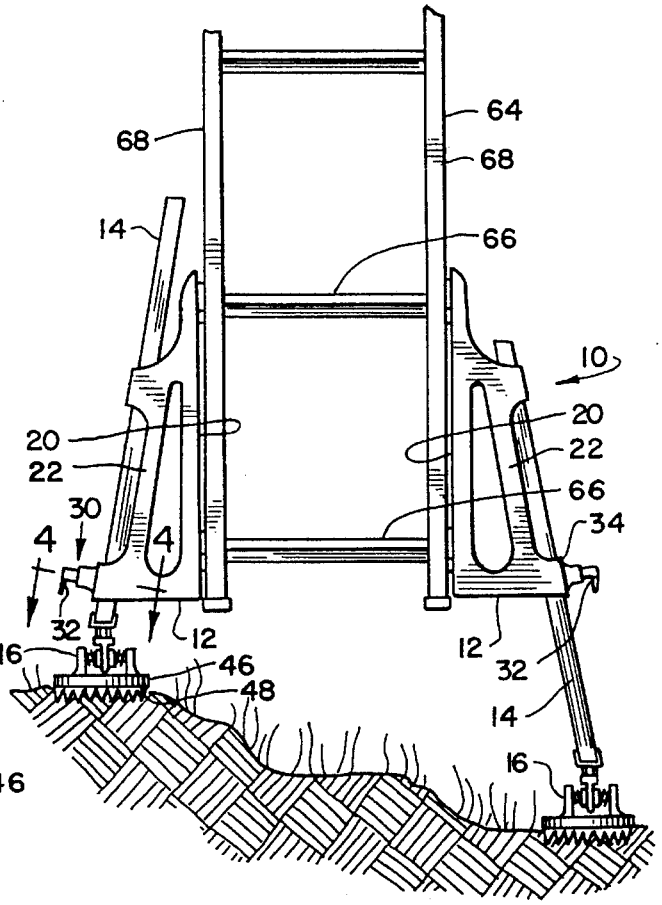
FIG. 3
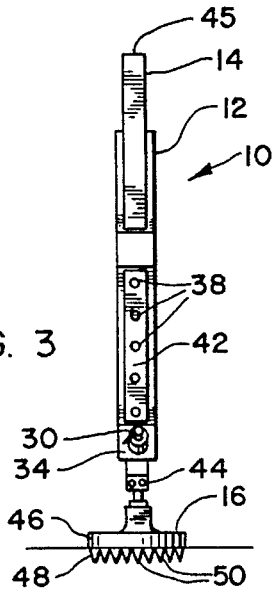
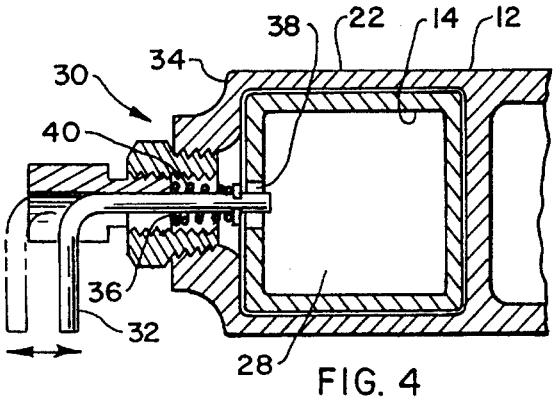
FIG. 4

LADDER STABILIZER

BACKGROUND

1. Field of the Invention

This patent relates to devices for stabilizing ladders. More particularly, this patent relates to a device that attaches to the lower rungs of a ladder to improve ladder stability on level and uneven surfaces, improve structural integrity, and isolate the ladder from the ground to minimize the possibility of electrical shock.

2. Description of the Related Art

Ladders often must be used in areas where the ladder will stand on an uneven surface. In such instances, a leveling device may be used to level the ladder and improve its stability. In addition to increasing the stability of a ladder, it would be desirable if, in the case of aluminum type ladders, such a device could also insulate the ladder from the ground, thus minimizing the possibility of electrical shock. It would also be desirable if such a device attached through the hollow rungs of the ladder, thus improving the structural stability of the ladder by preventing twisting. Finally, it would be desirable if the stabilizer feet were attached to the stabilizer legs in such a way that the feet maintain full contact with the surface during raising and lowering of the ladder, thus helping to prevent the ladder from sliding away from the user.

A number of stabilizing devices have been disclosed in the prior art, including those in U.S. Pat. Nos. 5,107,958; 4,792,017; 4,423,797; 3,908,796; 2,914,135; and 2,177,677. However, none of these patents discloses a ladder stabilizer that embodies and possesses all the aforementioned desirable characteristics.

SUMMARY OF THE INVENTION

The present invention is a ladder stabilizer comprising a pair of main frame structures, at least one and preferably two transverse rods extending between the main frames, a pair of legs slidably mounted to the main frames, and means for locking the legs to the main frames at the desired heights.

Preferably, each main frame has a hole extending horizontally through one face of the main frame to accommodate a locking pin. Each leg has a plurality of holes spaced evenly apart at a predetermined distance. The leg holes and the main frame hole cooperate with a locking means to lock each leg independently at a desired height.

In the preferred embodiment, the locking means is a pin mounted on each frame. In the locked position, the main frame hole is aligned with a hole in the corresponding leg and the pin extends therethrough. The pin is biased in the locking position by a spring or other means, and can be disengaged by pulling the locking pin away from the main frame.

The preferred embodiment also comprises means for isolating the ladder from the ladder stabilizer and therefore the ground, thus minimizing the possibility of electrical shock.

The present invention is designed for use with aluminum or fiberglass type ("D-rung") ladders having hollow, usually D-shaped, rungs through which may be placed the transverse rods of the invention. The ladder stabilizer is easy to attach to a D-rung ladder and easy to use.

Thus it is an object of the present invention to provide a ladder stabilizer of the type described above which possesses all of the aforenoted advantages.

A further object is to provide a ladder stabilizer that can be used with D-rung ladders to provide superior stability on level or uneven terrain.

A still further object is to provide a ladder stabilizer that insulates the ladder from the ground, thus minimizing the possibility of electrical shock.

Yet another object is to provide a ladder stabilizer that attaches through the rungs of a ladder, thus improving the structural integrity of the ladder by preventing twisting of the ladder side rails relative to one another.

Yet another object is to provide a ladder stabilizer that maintains full contact with the surface while the ladder is being raised or lowered, thus preventing the ladder from sliding away from the user.

Further and additional objects will appear from the description, accompanying drawings, and appended claims.

THE DRAWINGS

FIG. 1 is a fragmentary perspective view of a ladder with the ladder stabilizer of the present invention attached thereto.

FIG. 2 is a fragmentary front elevational view of a ladder with the ladder stabilizer of the present invention attached thereto.

FIG. 3 is a side elevational view of the ladder stabilizer of FIG. 2.

FIG. 4 is a cross sectional view taken along line 4—4 of FIG. 2.

DETAILED DESCRIPTION OF THE INVENTION

Figure 5:
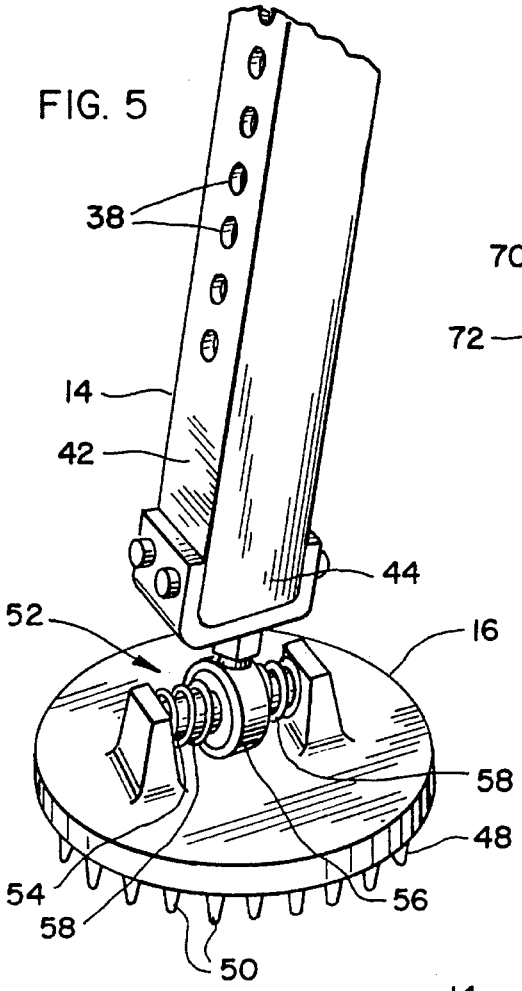
FIG. 5 is a perspective view of one of the legs and feet.

Turning to the drawings, there is shown in FIG. 1 one embodiment of a ladder stabilizer 10 according to the present invention. The ladder stabilizer 10 comprises a pair of main frames 12, legs 14 configured to slidingly engage the main frames 12, feet 16 attached to the legs 14, and transverse members 18 extending from one main frame 12 to the opposite main frame 12.

The main frames 12 may be mirror images of each other. In the illustrated embodiment, each main frame 12 comprises a vertical portion 20 and a diagonal portion 22 adapted to hold the legs 14 in sliding fashion. The vertical portion 20 has two horizontally extending holes 24, 26 (FIG. 7) for accommodating the transverse members 18. The upper hole 24 has a diameter slightly larger than the diameter of the transverse members 18. The lower hole may 26 is key-shaped, that is, it has a large diameter portion and a smaller diameter portion extending downwardly therefrom. This key-shape configuration allows for the insertion of a transverse member 18 with a hex nut and washer attached, and facilitates attachment of the ladder stabilizer 10 to a ladder.

As best shown in FIG. 4, the main frame diagonal portion 22 has square shaped openings 28 to accommodate a leg 14 having a square cross section. However, legs having other cross sectional shapes are contemplated; the openings 28 in the diagonal portion 22 of the main frame 12 can be configured accordingly.

Each main frame 12 also has means 30 for locking a leg 14 to the main frame 12 at a desired height, as will now be described. In the embodiment shown in FIGS. 1–4, this locking means is an L-shaped pin 32 mounted on the outer facing side 34 of the diagonal portion 22 of the main frame 12. In the locked position, the pin 32 extends through a horizontally extending hole 36 in the main frame 12 (FIG. 4) and another horizontally extending hole 38 in the leg 14. The pin 32 is biased into the locked position by a spring 40.

Figure 6:
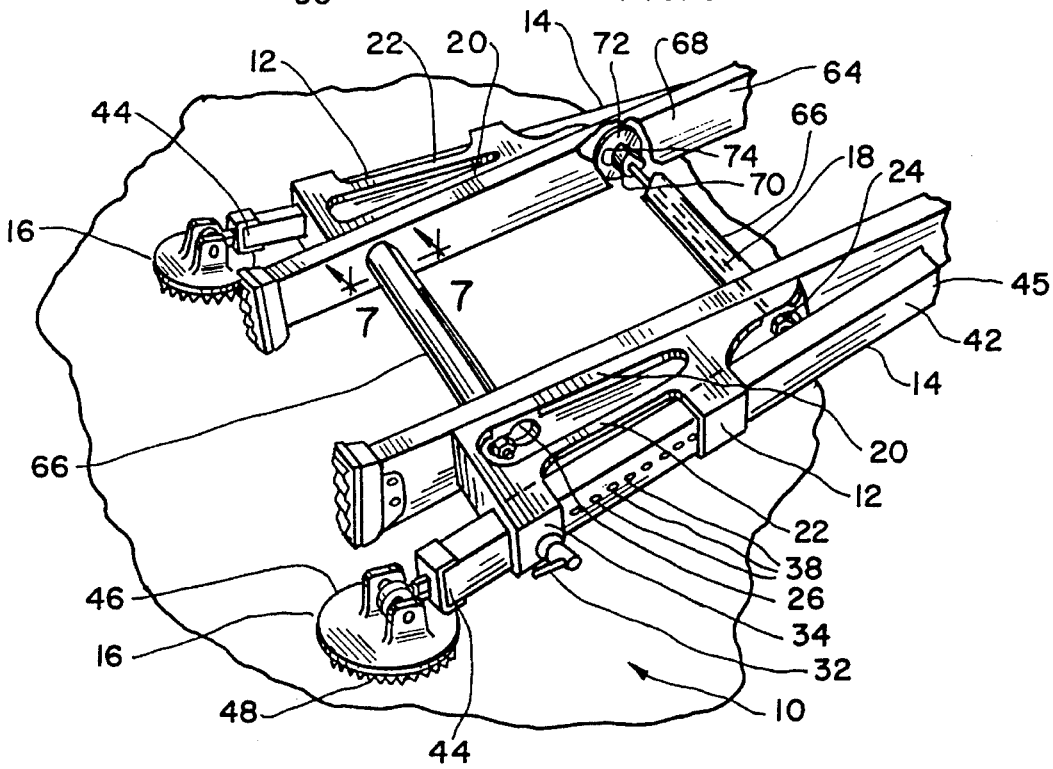
FIG. 6 is a perspective view of the ladder and ladder stabilizer of FIG. 2, showing how the stabilizer feet can swivel so as to maintain maximum contact with the surface, even when the ladder is almost parallel with the surface.

As can be seen in FIGS. 3, 5 and 6, each leg 14 comprises a series of horizontally extending holes 38 spaced vertically along the outer facing side 42 of the leg 14 that allow the leg height to be adjusted. Adjusting the leg height is accomplished by simply pulling the pin 32 away from the main frame 12, thereby allowing the leg 14 to slide freely within the diagonal portion 22 of the main frame 12. When the leg 14 is adjusted to the desired height (and one of the holes 38 in the leg 14 is aligned with the hole 36 in the main frame 12), the pin 32 is released, locking the leg 14 into position.

Feet 16 may be attached to the bottom end 44 of each leg 14. In the embodiment shown in FIGS. 1–7, each foot comprises a substantially flat, circular plate 46 and a cleated bottom 48 matingly engaged to the underside of the plate 46. The cleated bottom 48 may be a flat pad formed of hard rubber. Hard but flexible rubber cleats 50 extend downward from the pad 48 to provide a gripping surface usable on most terrains.

Each foot 16 is attached to a leg 14 by attaching means that allows for rotation of the foot 16 in almost any direction. One embodiment of an attaching means 50 is shown in FIG. 5. In this preferred embodiment, each foot 16 is attached to a leg 14 with a combination axle 54 and ball joint 56. The axle 54 enables the foot 16 to be rotated approximately 180 degrees about the axle 54. The ball joint 56 enables the foot 16 to rotate along an axis perpendicular to the axle 54. Thus, the combination of the axle and ball joint allows the foot 16 to swivel to an infinite number of positions in all three spacial dimensions. The ball joint 52 may be centered along the axle 54 by a pair of springs 58, as shown in FIG. 5.

As noted above, a pair of transverse members or rods 18 extend from one main frame 12 to the other. The top transverse rod 18 extends from the upper hole 24 located in the vertical portion 20 of one main frame 12 to the upper hole 24 in the vertical portion 20 of the other main frame 12. The bottom transverse rod 18 extends from the lower (key-shaped) hole 26 of one main frame 12 to the lower hole 26 of the other main frame 12.

One end of each transverse rod 18 forms a hexagonal head and the opposite end is threaded to accommodate a hex nut, wing nut, or other fastener. Washers may be interposed between the transverse rod hexagonal heads and one main frame, and between the fasteners and the other main frame. Either flat washers or lock washers may be used. In the preferred embodiment, ⅜ inch metal flat washers are used.

When the ladder stabilizer 10 is attached to a ladder 64, the transverse rods 18 extend through the hollow rungs 66 of the lower portion of the ladder 64 (Fig. 6). In this way, ladder stability is enhanced because the rods 18 help prevent twisting of the ladder side rails 68.

The ladder stabilizer 10 may also comprise means for electrically isolating the ladder from the ground, thus lessening the possibility of electrical shock. In the preferred embodiment, the isolating means are four electrically non-conducting mount bushings 70 located at either end of the transverse members 18 and interposed between the ladder side rails 68 and the main frames 12 (FIG. 6). The bushings 70 prevent the ladder 64 from contacting the electrically conductive components of the ladder stabilizer 10, thus isolating the ladder 64 from the ground. The bushings 70 may be formed of nylon or any suitable non-conductive material.

Figure 7:
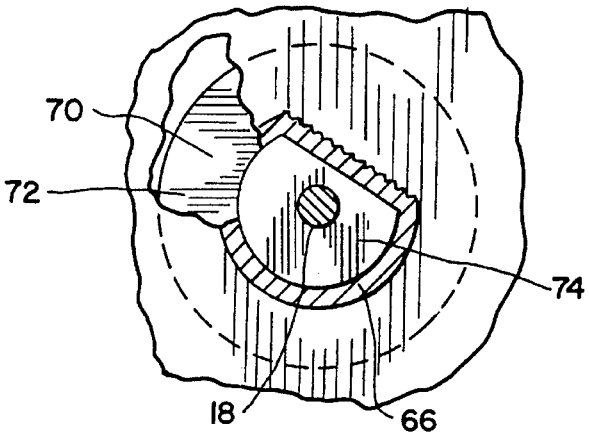
FIG. 7 is a cross sectional view taken along line 7—7 of FIG. 6.

The bushings have a flat circular portion 72 and a D-shaped portion 74 extending perpendicularly away from the flat portion 72. The flat portion 72 separates the ladder side rails 68 from the main frames 12, and the D-shaped portion 74 fits snugly inside the ladder rungs 66, as best shown in FIG. 7. Some aluminum or fiberglass type ladders have rungs with O-shaped hollow interiors. Thus, while the bushings shown are D-shaped, other bushing configurations are possible, including substantially cylindrical bushings.

The ladder stabilizer 10 may be readily attached to a ladder 64 in the following manner. First, the stabilizer main frames 12 are raised with respect to the legs 14 so that the main frame upper holes 24 are elevated above the upper ends 45 of the legs 14, allowing for the insertion of one of the transverse rods 18 through the upper holes 24. With the ladder 64 laying flat on the ground, the four nylon bushings 70 are fitted into either end of the lowest two rungs 66 on the ladder 64. One transverse rod 18 is inserted through the bushings 70 in lowest rung of the ladder 64 and secured with a washer and fastener. The two main frames 12 are then placed on either side of the ladder 64 such that the ends of the transverse rod 18 are aligned with the key-shaped holes 26 of the main frames 12. The main frames 12 are fitted onto the ends of the transverse rod 18, substantially flush against the ladder side rails 68, and adjusted upward so that the small diameter portions of the key-shaped holes 26 hold the main frames 12 tight against the ladder 64. A washer and fastener is then attached to the threaded end of the rod 18.

With the lower transverse rod 18 in place, the upper holes 24 on the main frames 12 are now aligned with the next-to-lowest ladder rung. The second transverse rod 18 is inserted through the next-to-lowest rung and secured with a washer and fastener.

If the ladder 64 is to be used on an uneven surface (see FIG. 2), one or both stabilizer legs 12 can be adjusted for height simply by pulling the locking pin 32 away from the main frame 12, sliding the leg 14 to the desired height such that one of the leg holes 38 is aligned with the horizontally extending hole 36 on the outer facing side 42 of the main frame 12, and releasing the pin 32. The pin 32 engages both the leg 14 and the main frame 12, locking the leg 14 at the desired height.

With the stabilizer 10 attached to the ladder 64, the stabilizer feet 16 maintain full contact with the surface during raising or lowering of the ladder 64, thereby helping to prevent the ladder 64 from sliding away from the user. As shown in FIG. 6, even when the ladder 64 is laying flat on a surface, the stabilizer feet 16 maintain full contact with the surface. The hard rubber cleats 50 on the ladder feet 16 help to prevent the ladder 64 from slipping on most terrains.

Thus I have described a ladder stabilizer 10 that provides a reliable means for stabilizing a D-rung type ladder on level surfaces or uneven surfaces. The stabilizer 10 is attached through the ladder rungs, improving the structural integrity of the ladder by preventing twisting.

The stabilizer feet 16 rotate to maintain maximum contact with the surface, even when the ladder is being raised or lowered. Hard rubber cleats 50 on the ladder feet 16 enable the stabilizer 10 to be used on most terrains. The feet 16 maintain full contact with the surface during raising and lowering of the ladder, helping to prevent the ladder from sliding away from the user. Electrically nonconductive bushings 70 electrically isolate the ladder from the ground, minimizing the possibility of electrical shock.

The ladder stabilizer 10 is easy to use. Drilling and clamping are not required to attach the stabilizer 10 to a ladder. There is no need to remove existing ladder feet because the stabilizer bypasses them.

Other modifications and alternative embodiments of the invention are contemplated which do not depart from the spirit and scope of the invention as defined by the foregoing teachings and appended claims.

I claim as my invention:

1. A ladder stabilizer for use with a ladder having side rails and a plurality of hollow horizontal rungs therebetween, said ladder stabilizer comprising:

a pair of main frames, each main frame having a vertical portion for attachment to a respective side rail and a diagonal portion, the vertical portion having two holes spaced a distance equal to the distance between the hollow horizontal rungs of the ladder, the diagonal portion having a hole for accommodating a locking means;

two transverse rods, each adapted to extend through one of said plurality of horizontal rungs and having ends removably secured to the vertical portions of the main frames;

a pair of legs, each leg slidably mounted to the diagonal portion of one of the pair of main frames and having a plurality of horizontally extending holes spaced vertically along an outer facing side of the leg;

locking pins mounted on the diagonal portion of each main frame, wherein in the locked position one of the holes in each of the legs is aligned with the hole in the diagonal portion of the main frame and the locking pins extend through the aligned holes, and wherein each locking pin can be disengaged from the holes independent of the other locking pin by pulling one end of the locking pin in a direction away from the aligned holes; and a pair of feet, one foot secured to each of the legs in a swivel manner by means of a ball joint, each foot comprising a foot plate and a plurality of rubber projections extending downwardly therefrom, said feet supporting the entire weight of and on the ladder wherein when said main frames are operatively connected to said rails movement of the legs along the main frames varies the horizontal distance between the feet.

2. The ladder stabilizer of claim 1 further comprising electrically non-conducting mount bushings located at either end of the transverse rods and interposed between the ladder side rails and the main frames, so that the ladder is insulated from the ground.

* * * * *